US005854520A

United States Patent [19]

Buck et al.

[11] Patent Number: 5,854,520

[45] Date of Patent: Dec. 29, 1998

[54] STOVE TIMER AND AUTOMATIC CUT OFF SYSTEM

[76] Inventors: Beatrice L. Buck; Beatrice B. Tibbitt, both of 124 Coal Valley Rd., Clairton, Pa. 15025; Loretta A. Sudsina, 3712 Bevan Rd., N. Versailles, Pa. 15137

[21] Appl. No.: 963,633

[22] Filed: Nov. 6, 1997

[51] Int. Cl.[6] ..... H05B 1/02

[52] U.S. Cl. ..... 307/141; 307/140; 218/482; 218/489; 219/490; 340/500

[58] Field of Search ..... 307/141, 141.4, 307/140; 219/490, 482, 489, 506, 483, 721; 340/500

[56] References Cited

U.S. PATENT DOCUMENTS

| | | | |
|---|---|---|---|
| D. 336,210 | 6/1993 | Birtwisle | D7/340 |
| 3,819,906 | 6/1974 | Gould | 219/506 |
| 4,204,149 | 5/1980 | Cleary et al. | 307/141.4 |
| 4,412,268 | 10/1983 | Dassow | 361/181 |
| 4,433,328 | 2/1984 | Saphir et al. | 340/555 |
| 4,533,810 | 8/1985 | Harmon et al. | 307/141.4 |
| 4,775,913 | 10/1988 | Ekbald | 361/179 |
| 4,782,420 | 11/1988 | Holdgaard-Jensen | 361/58 |
| 4,908,498 | 3/1990 | Kiela | 219/483 |
| 5,094,259 | 3/1992 | Hsu | 137/66 |
| 5,650,673 | 7/1997 | Maeda | 307/141.4 |

*Primary Examiner*—Albert W. Paladini

[57] ABSTRACT

A stove timer and automatic cut off system is provided including a stove having a plurality of burners each adapted to generate heat upon the receipt of power. A start switch situated on the stove is adapted for transmitting a start signal upon the depression thereof. A timer selector switch assembly is situated on the stove and has a plurality of discrete modes. The switch assembly is adapted to transmit a timer signal representative of a unique predetermined amount of time in each mode. An indication means is situated on the stove and is adapted to alert a user only during the actuation thereof. A relay is connected between the burners of the stove and a source of power. The relay is adapted to supply the burner with power only when actuated. Finally, a control mechanism serves to function in an activated mode only upon the receipt of the start signal wherein the control means actuates the relay. The control mechanism, while in the activated mode and upon the cessation of the predetermined amount of time represented by the timer signal, is adapted to actuate the alarm for an interim and further deactuate the relay and the alarm upon the cessation of the interim.

1 Claim, 2 Drawing Sheets

STOVE TIMER AND AUTOMATIC CUT OFF SYSTEM

BACKGROUND OF THE INVENTION

1. Field of the Invention

The present invention relates to stove cut off switches and more particularly pertains to a new stove timer and automatic cut off system for shutting off a stove after a predetermined amount of time.

2. Description of the Prior Art

The use of stove cut off switches is known in the prior art. More specifically, stove cut off switches heretofore devised and utilized are known to consist basically of familiar, expected and obvious structural configurations, notwithstanding the myriad of designs encompassed by the crowded prior art which have been developed for the fulfillment of countless objectives and requirements.

Known prior art stove cut off switches include U.S. Pat. No. 4,782,420; U.S. Pat. No. 4,775,913; U.S. Pat. Des. 336,210; U.S. Pat. No. 5,094,259; U.S. Pat. No. 4,433,328; and U.S. Pat. No. 4,412,268.

In these respects, the stove timer and automatic cut off system according to the present invention substantially departs from the conventional concepts and designs of the prior art, and in so doing provides an apparatus primarily developed for the purpose of shutting off a stove after a predetermined amount of time.

SUMMARY OF THE INVENTION

In view of the foregoing disadvantages inherent in the known types of stove cut off switches now present in the prior art, the present invention provides a new stove timer and automatic cut off system construction wherein the same can be utilized for shutting off a stove after a predetermined amount of time.

The general purpose of the present invention, which will be described subsequently in greater detail, is to provide a new stove timer and automatic cut off system apparatus and method which has many of the advantages of the stove cut off switches mentioned heretofore and many novel features that result in a new stove timer and automatic cut off system which is not anticipated, rendered obvious, suggested, or even implied by any of the prior art stove cut off switches, either alone or in any combination thereof.

To attain this, the present invention generally comprises a stove having a plurality of burners. Each of such burners is adapted to generate heat upon the depression of an associated actuation switch in combination with the receipt of power. The stove further includes a control panel to which the actuation switches are mounted. Note FIG. 1. Situated on the control panel of the stove is a start switch for transmitting a start signal upon the depression thereof. Associated therewith is a clear switch situated on the control panel of the stove for transmitting a clear signal upon the depression thereof. A timer selector switch assembly resides adjacent to the remaining switches and has a plurality of discrete orientations, or modes. During use, the timer switch assembly serves to transmit a timer signal representative of a unique predetermined amount of time in each orientation. Also included is an audio means, in the form of a piezo electric buzzer, situated on the control panel of the stove. The buzzer functions to emit an audible alarm only during the actuation thereof. For reasons that will become apparent hereinafter, a display is situated on the control panel of the stove for depicting a plurality of numeric digits thereon.

Connected between the burners of the stove and a source of power is a relay means. The relay means is adapted to supply the burner with power only during the actuation thereof. Finally, a control means is connected between the start switch, clear switch, timer selector switch, audio means, display, and relay means. The control means is adapted to function in an activated mode only upon the receipt of the start signal. While in the activated mode, the control means actuates the relay means and further depicts a decrementing timer on the display which decrements from the predetermined amount of time represented by the timer signal. While in the activated mode and upon the receipt of the start signal, the control means is further adapted to continuously actuate the relay means and further depict on the display a decrementing timer which decrements again from the predetermined amount of time represented by the timer signal currently received. The control means, while in the activated mode and upon the cessation of the predetermined amount of time represented by the timer signal, is adapted to actuate the alarm for an interim. Such interim is preferably approximately 5 minutes. Upon the cessation of the interim, the control means deactuates the relay means and the alarm. Lastly, while in the activated mode and upon the receipt of the clear signal, the control means is further adapted to merely deactuate the relay means.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new stove timer and automatic cut off system apparatus and method which has many of the advantages of the stove cut off switches mentioned heretofore and many novel features that result in a new stove timer and automatic cut off system which is not anticipated, rendered obvious, suggested, or even implied by any of the prior art stove cut off switches, either alone or in any combination thereof.

It is another object of the present invention to provide a new stove timer and automatic cut off system which may be easily and efficiently manufactured and marketed.

It is a further object of the present invention to provide a new stove timer and automatic cut off system which is of a durable and reliable construction.

An even further object of the present invention is to provide a new stove timer and automatic cut off system which is susceptible of a low cost of manufacture with regard to both materials and labor, and which accordingly is then susceptible of low prices of sale to the consuming public, thereby making such stove timer and automatic cut off system economically available to the buying public.

Still yet another object of the present invention is to provide a new stove timer and automatic cut off system which provides in the apparatuses and methods of the prior art some of the advantages thereof, while simultaneously overcoming some of the disadvantages normally associated therewith.

Still another object of the present invention is to provide a new stove timer and automatic cut off system for shutting off a stove after a predetermined amount of time.

Even still another object of the present invention is to provide a new stove timer and automatic cut off system that includes a stove having a plurality of burners each adapted to generate heat upon the receipt of power. A start switch situated on the stove is adapted for transmitting a start signal upon the depression thereof. A timer selector switch assembly is situated on the stove and has a plurality of discrete modes. The switch assembly is adapted to transmit a timer signal representative of a unique predetermined amount of time in each mode. An indication means is situated on the stove and is adapted to alert a user only during the actuation thereof. A relay is connected between the burners of the stove and a source of power. The relay is adapted to supply the burner with power only when actuated. Finally, a control mechanism serves to function in an activated mode only upon the receipt of the start signal wherein the control means actuates the relay. The control mechanism, while in the activated mode and upon the cessation of the predetermined amount of time represented by the timer signal, is adapted to actuate the alarm for an interim and further deactuate the relay and the alarm upon the cessation of the interim.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
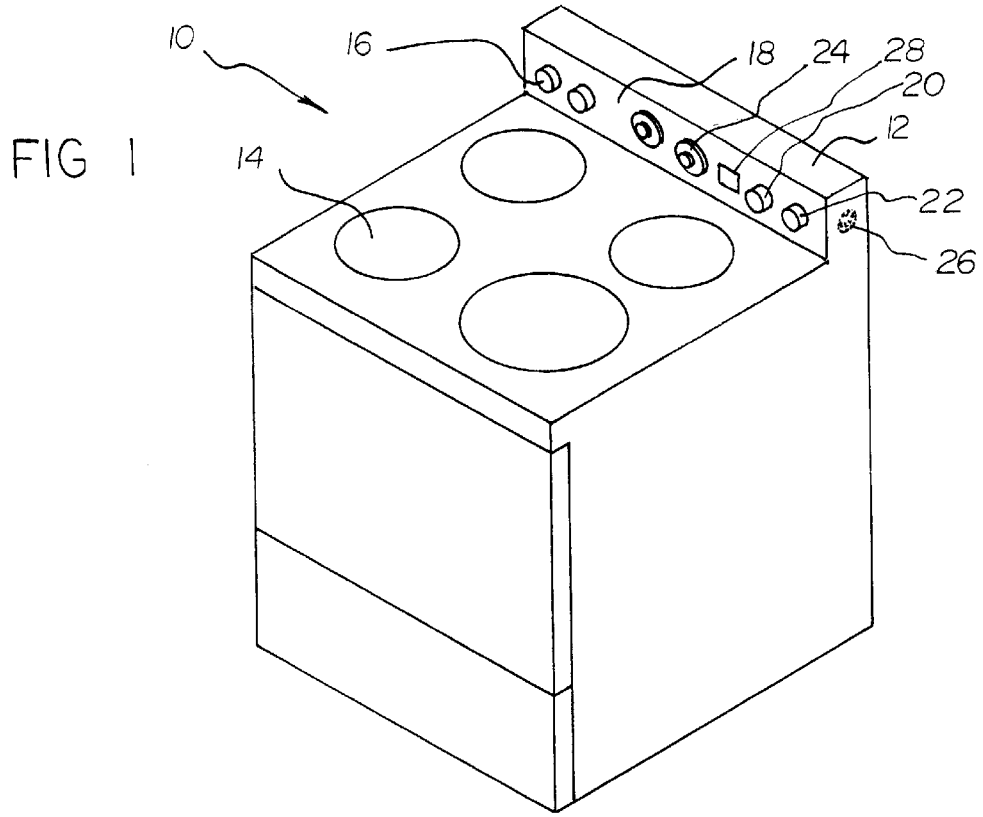
FIG. 1 is a perspective view of a new stove timer and automatic cut off system according to the present invention.
Figure 2:
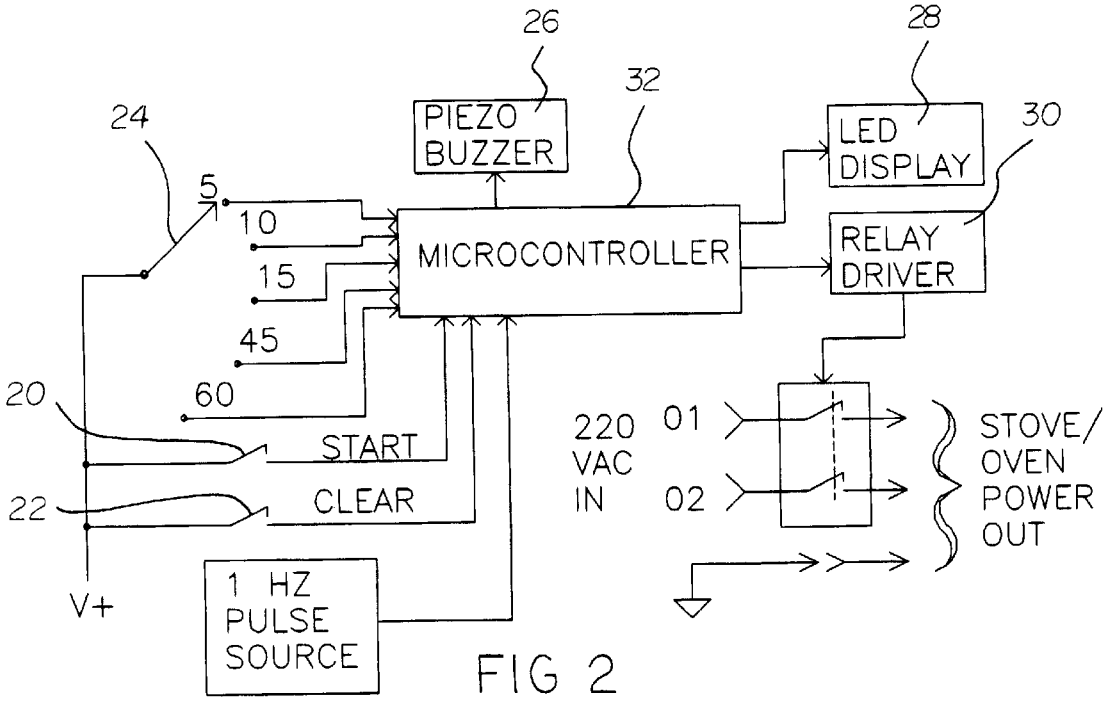
FIG. 2 is a schematic diagram of the present invention.
Figure 3:
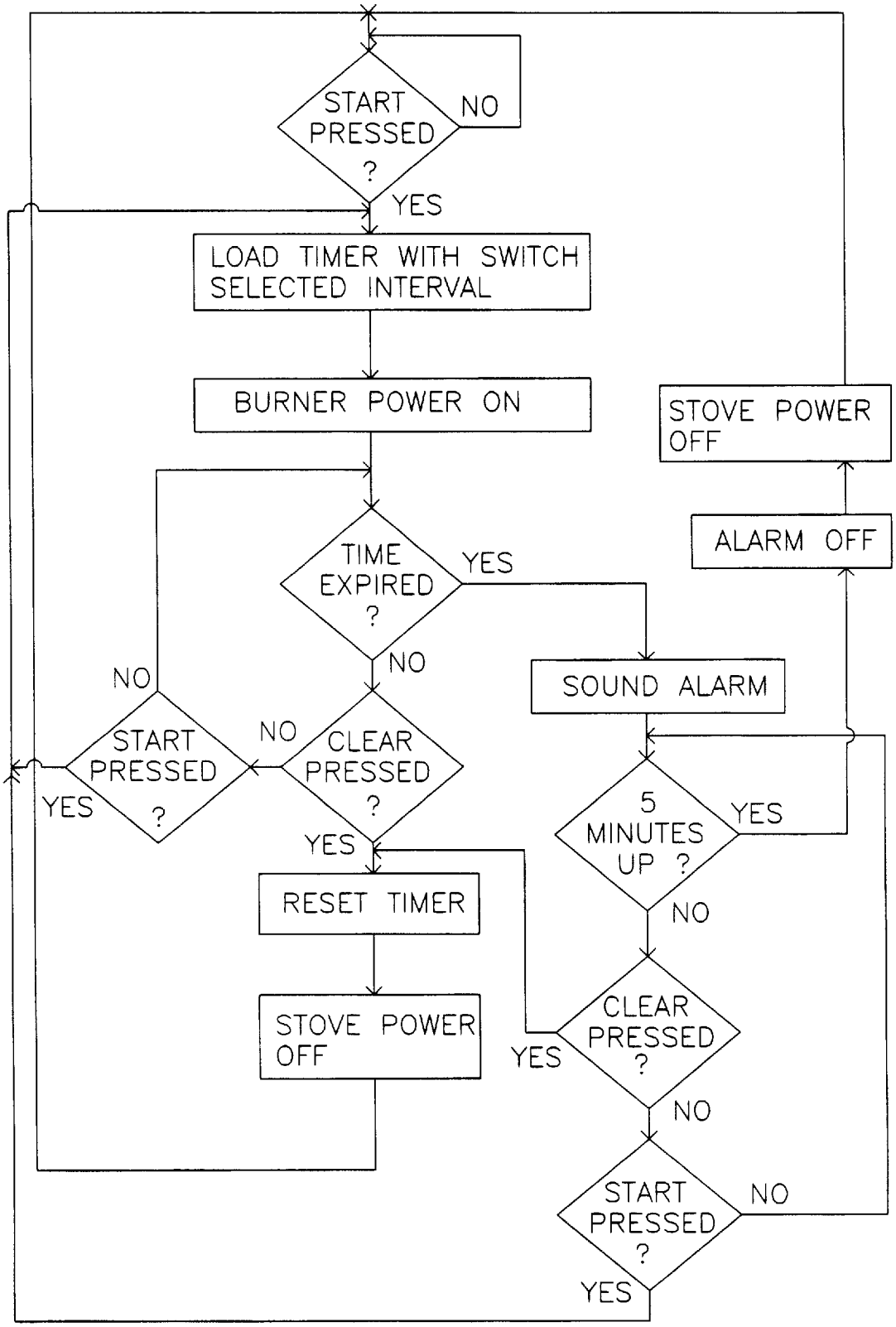
FIG. 3 is a flow chart depicting the operation associated with the present invention.

With reference now to the drawings, and in particular to FIGS. 1 through 3 thereof, a new stove timer and automatic cut off system embodying the principles and concepts of the present invention and generally designated by the reference numeral 10 will be described.

The present invention, as designated as numeral 10, includes a stove 12 having a plurality of burners 14. Each of such burners is adapted to generate heat upon the depression of an associated actuation switch 16 in combination with the receipt of power. The stove further includes a control panel 18 to which the actuation switches are mounted. Note FIG. 1.

Situated on the control panel of the stove is a start switch 20 for transmitting a start signal upon the depression thereof. Associated therewith is a clear switch 22 situated on the control panel of the stove for transmitting a clear signal upon the depression thereof. A timer selector switch 24 assembly, in the form of a dial or the like, resides adjacent to the remaining switches and has a plurality of discrete orientations, or modes. During use, the timer switch assembly serves to transmit a timer signal representative of a unique predetermined amount of time in each orientation. Such times preferably comprise of 5, 10, 15, 45, and 60 minutes.

Also included is an audio means 26, in the form of a piezo electric buzzer, situated on the control panel of the stove. The buzzer functions to emit an audible alarm only during the actuation thereof. For reasons that will become apparent hereinafter, a light emitting diode display 28 is situated on the control panel of the stove for depicting a plurality of numeric digits thereon.

Connected between the burners of the stove and a source of power is a relay means 30. The relay means is adapted to supply the burner with power only during the actuation thereof. As shown in FIG. 2, the relay means provide the actuation switches with power which, in turn, provide the associated burner with power upon the actuation thereof.

Finally, a control means 32 is connected between the start switch, clear switch, timer selector switch, audio means, display, and relay means. In the preferred embodiment, the control means comprises of a microcontroller, as shown in FIG. 2. The function of the microcontroller can be seen in FIG. 3.

In operation, the control means is adapted to function in an activated mode only upon the receipt of the start signal. While in the activated mode, the control means actuates the relay means and further depicts a decrementing timer on the display which decrements from the predetermined amount of time represented by the timer signal.

While in the activated mode and upon the receipt of the start signal, the control means is further adapted to continuously actuate the relay means and further depict on the display a decrementing timer which decrements again from the predetermined amount of time represented by the timer signal currently received. In other words, the control means restarts the timer on the display in accordance with which orientation the timer switch assembly is currently set.

The control means, while in the activated mode and upon the cessation of the predetermined amount of time represented by the timer signal, is adapted to actuate the alarm for an interim. Such interim is preferably approximately 5 minutes. Prior to the end of the interim, the control means is adapted to restart the timer, deactuate the alarm and remains in the activated mode upon the receipt of the start signal. If the clear signal is received, the control means only deactuates the alarm. Upon the cessation of the interim, the control means is removed from the activated mode and deactuates the relay means and the alarm.

Lastly, while in the activated mode and upon the receipt of the clear signal, the control means is further adapted to merely deactuate the relay means and not activate the alarm. As such, a user may disarm the present invention and prevent the alarm from activating after use of the stove. It should be noted that the burners of the stove may not be used until the depression of the start button which in turn effects a mandatory timer. As an option added safety feature, the timer switch assembly may be adapted to default to 5 minutes upon each depression of the start button thus requiring the user to depress a more lengthy time if desired. This precludes the user from inadvertently leaving the timer on a lengthy time such as 60 minutes.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A stove timer and automatic cut off system comprising, in combination:

a stove having a plurality of burners each adapted to generate heat upon the receipt of power, the stove further including a control panel;

a start switch situated on the control panel of the stove for transmitting a start signal upon the depression thereof;

a clear switch situated on the control panel of the stove for transmitting a clear signal upon the depression thereof;

a timer selector switch assembly situated on the control panel of the stove and having a plurality of discrete orientations, wherein the switch assembly is adapted to transmit a timer signal representative of a unique predetermined amount of time in each orientation;

an audio means situated on the control panel of the stove and adapted to emit an audible alarm only during the actuation thereof;

a display situated on the control panel of the stove for depicting a plurality of numeric digits thereon;

relay means connected between the burners of the stove and a source of power, the relay means adapted to supply the burner with power only during the actuation thereof; and control means connected between the start switch, clear switch, timer selector switch assembly, audio means, display, and relay means, the control means adapted to function in an activated mode only upon the receipt of the start signal wherein the control means actuates the relay means and further depicts a decrementing timer on the display which decrements from the predetermined amount of time represented by the timer signal, the control means, while in the activated mode and upon the receipt of the start signal, adapted to continuously actuate the relay means and further depict on the display a decrementing timer which decrements again from the predetermined amount of time represented by the timer signal currently received, the control means, while in the activated mode and upon the cessation of the predetermined amount of time represented by the timer signal, adapted to actuate the alarm for an interim and further deactuate the relay means and the alarm upon the cessation of the interim, the control means, while in the activated mode and upon the cessation of the predetermined amount of time represented by the timer signal and further upon the receipt of the start signal, adapted to continuously actuate the relay means and further depict on the display a decrementing timer which decrements again from the predetermined amount of time represented by the timer signal currently received, the control means, while in the activated mode and upon the receipt of the clear signal, further adapted to merely deactuate the relay means;

wherein the timer selector switch assembly is adapted to default to a predetermined non-zero setting upon each depression of the start switch thereby requiring the user to depress a more lengthy setting if desired.

* * * * *